US005167561A

United States Patent [19]

Rizzo

[11] Patent Number: 5,167,561

[45] Date of Patent: Dec. 1, 1992

[54] DOLL SYSTEM FOR SIMULATING WEIGHT GAIN AND WEIGHT LOSS

[76] Inventor: Frank D. Rizzo, 709 Pennsylvania Ave., Lyndhurst, N.J. 07071

[21] Appl. No.: 793,528

[22] Filed: Nov. 18, 1991

[51] Int. Cl.[5] ..... A63H 3/06

[52] U.S. Cl. ..... 446/224; 446/226; 446/320

[58] Field of Search ..... 446/197, 199, 198, 226, 446/224, 320

[56] References Cited

U.S. PATENT DOCUMENTS 1,266,296 5/1918 Mark ..... 446/226 X
2,170,539 8/1939 Schoberg ..... 446/226
2,701,672 2/1955 Glasco ..... 446/226 X
5,033,985 7/1991 Nahas ..... 446/226 X

*Primary Examiner*—Mickey Yu
*Attorney, Agent, or Firm*—Samuelson & Jacob

[57] ABSTRACT

A doll system simulates weight gain and weight loss in a doll by the selective expansion and contraction of parts of the doll subject to simulated weight gain and weight loss by selectively coupling a chamber within the doll with a pressure-raising apparatus configured to simulate a weight gain object or a pressure-lowering apparatus configured to simulate a weight loss object and operating the coupled apparatus to either raise the pressure within the chamber to simulate weight gain or lower the pressure within the chamber to simulate weight loss.

14 Claims, 3 Drawing Sheets

DOLL SYSTEM FOR SIMULATING WEIGHT GAIN AND WEIGHT LOSS

The present invention relates generally to dolls and pertains, more specifically, to a doll system which serves an educational purpose, as well as being entertaining.

Dolls have been a staple in toys for a very long time. Dolls and doll systems have been developed for demonstrating and performing almost every conceivable function. The doll system of the present invention demonstrates the effects of eating various foods on weight gain and on weight loss and serves to educate and inform children in dietary matters. As such, the present invention exhibits several objects and advantages, some of which may be summarized as follows: Provides an entertaining as well as informative doll system for educating and informing children of the effects on weight gain and weight loss of eating various foods, while at the same time entertaining the children for enhanced retention and learning about dietary matters; enables a simplified yet effective doll construction for demonstrating the effects of weight gain and weight loss on the body; provides a "hands-on" approach to teaching children about diet and the effects of the consumption of instantly recognizable commonly available foods on weight gain and on weight loss; enables children of a wide range of ages to understand and appreciate the effects of diet and weight gain and weight loss on the body; provides a doll system which is simple in use and is manufactured readily in large numbers of high quality for widespread availability with economy.

The above objects and advantages, as well as further objects and advantages, are attained by the present invention which may be described briefly as a doll system enabling the simulation of weight gain and weight loss in a doll by the selective expansion and contraction of parts of the doll subject to simulated weight gain and weight loss, the doll system comprising: a doll body having a shell including a wall having first wall portions delineating the parts of the doll subject to simulated weight gain and weight loss, and adjacent second wall portions; a chamber within the doll body and communicating with the first wall portions of the shell, the first wall portions being expansible and contractible relative to the second wall portions in response to raised and lowered pressure, respectively, within the chamber; valve means normally sealing the chamber against ambient pressure; a first apparatus configured to simulate a weight gain object, the first apparatus including selectively, operated pressure-raising means; a second apparatus configured to simulate a weight loss object, the second apparatus including selectively operated pressure-lowering means; and selective coupling means for selectively coupling one of the first apparatus and the second apparatus with the valve means such that selective coupling of the first apparatus with the valve means and operation of the first apparatus will raise the pressure within the chamber and expand the first wall portions of the doll body relative to the second wall portions to simulate weight gain, and selective coupling of the second apparatus with the valve means and operation of the second apparatus will lower the pressure within the chamber and contract the first wall portions of the doll body to simulate weight loss.

The invention will be understood more fully, while still further objects and advantages will become apparent, in the following detailed description of preferred embodiments of the invention illustrated in the accompanying drawing, in which.

Figure 1:
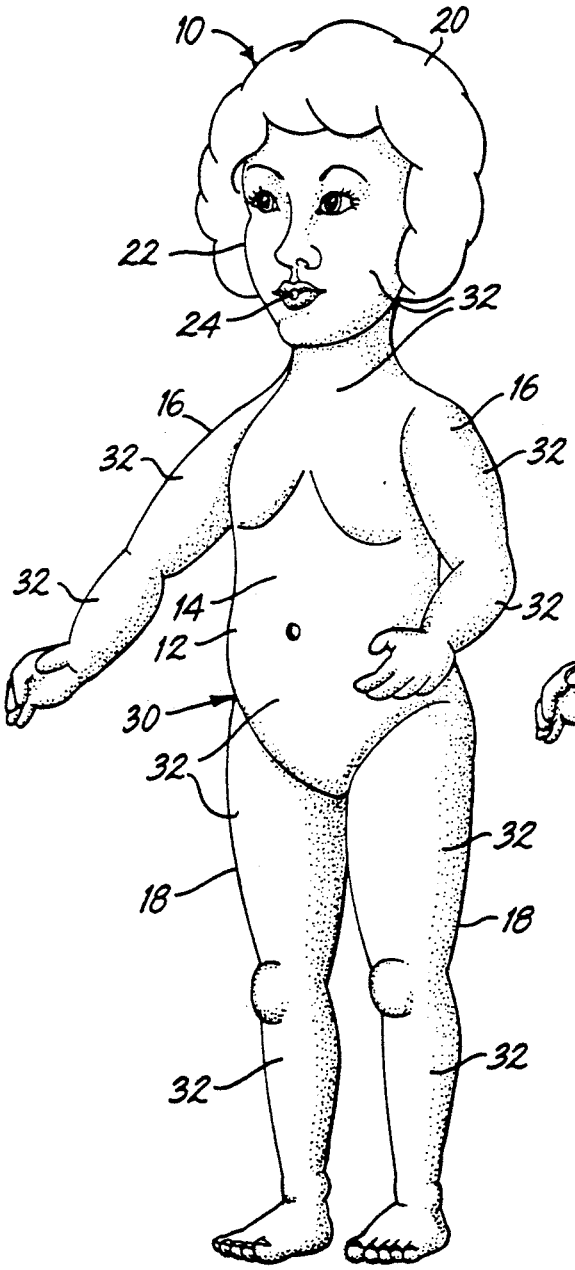
FIG. 1 is a pictorial perspective view of a doll constructed in accordance with the invention, for use in the doll system of the invention.
Figure 2:
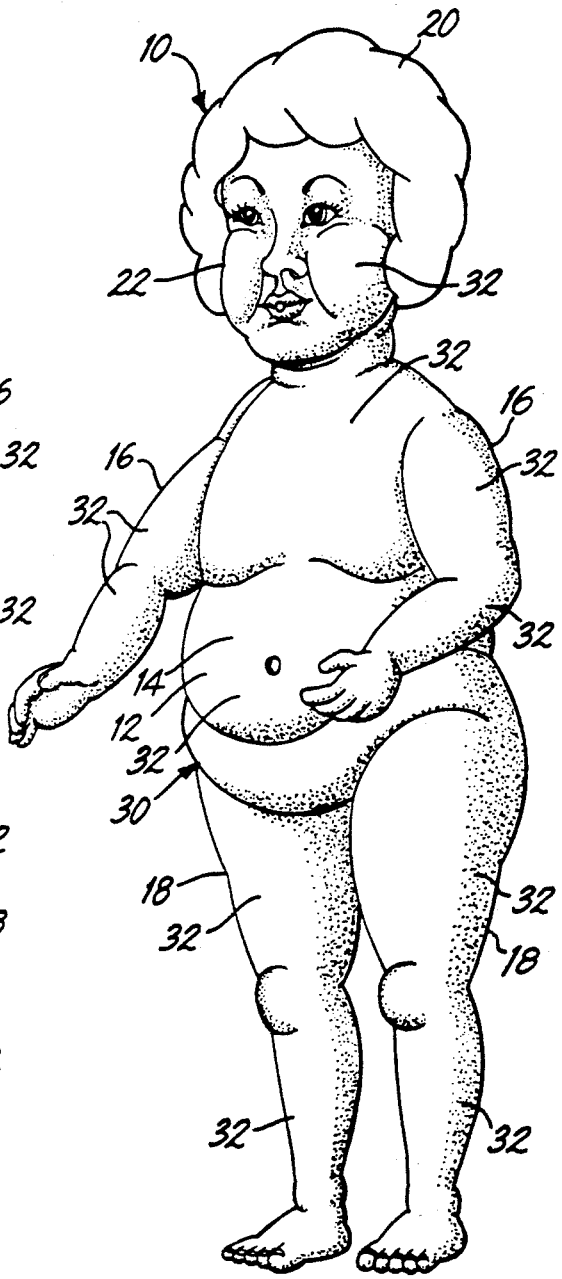
FIG. 2 is a pictorial perspective view similar to FIG. 1 and illustrating another condition of the doll.

Referring now to the drawing, and especially to FIG. 1 thereof, a doll 10 constructed in accordance with the invention is seen in a normal condition in which the doll 10 simulates a human figure having a normal weight. Doll 10 includes a doll body 12 having a torso 14 and limbs in the form of arms 16 and legs 18. A head 20 includes a face 22 having a mouth 24. Doll body 12 is constructed in the form of a shell 30 having a wall 31 including first wall portions 32 which delineate predetermined parts of the torso 14, the arms 16 and the legs 18, as well as the face 22. In FIG. 2, the doll 10 is in an expanded condition and simulates weight gain. In the expanded condition, the torso 14, arms 16 and legs 18, and the face 22 all are expanded so as to demonstrate the effects of weight gain on the appearance of the doll 10.

Figure 3:
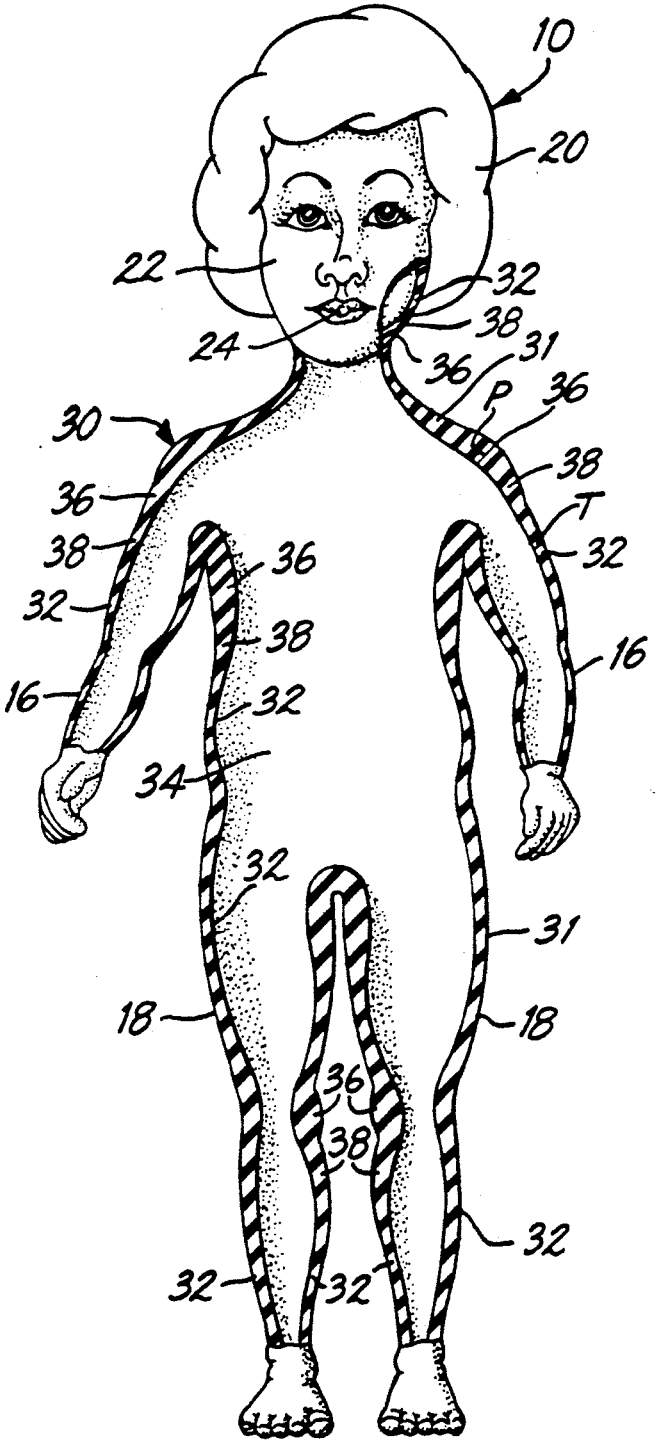
FIG. 3 is a longitudinal cross-sectional view of the doll.

Turning to FIG. 3, shell 30 is seen to be hollow so as to include within shell 30 a chamber 34 communicating with the wall portions 32. The wall portions 32 are expansible and contractible in response to raised and lowered pressure, respectively, within the chamber 34, preferably by constructing shell 30 of an elastomeric material, such as rubber or a similar elastomeric synthetic polymeric material, and by providing the wall portions 32 with a wall thickness T which is less than the predetermined wall thickness P of adjacent second wall portions 36 of the wall 31 of shell 30 in general. In this manner, increased pressure within the chamber 34 will expand wall portions 32 relative to adjacent wall portions 36 of the wall 31 of shell 30 to achieve the condition illustrated in FIG. 2. Reduced pressure in the chamber 34 will contract the wall portions 32 relative to the wall portions 36 of the wall 31 of the shell 30. It is noted that the transition from the thicker wall portions 36 of the wall 31 of the shell 30, in general, to the thinner wall portions 32 is gradual, as shown at transitional wall portions 38 intermediate the thinner wall portions 32 and the thicker adjacent wall portions 36, which intermediate wall portions 38 have a wall thickness which increases gradually from the first wall portions 32 to the corresponding adjacent second wall portions 36, so as to enable a graduated expansion along the transitional wall portions 38, which graduated expansion maintains a more natural appearance in the doll 10 in the expanded condition.

Figure 4:
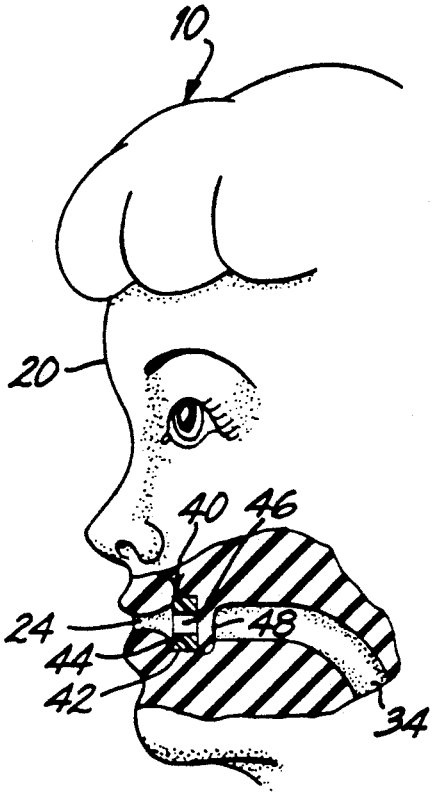
FIG. 4 is an enlarged, fragmentary view of a portion of the doll cut away to illustrate internal details.

As seen in FIG. 4, chamber 34 normally is sealed against ambient pressure by valve means shown in the form of a valve 40 located in the mouth 24 of the face 22 of doll 10. Valve 40 includes an annular valve seat 42 fitted into a complementary annular groove 44 in the head 20 of the doll 10, within mouth 24, and having a valve passage 46. A valve member in the form of a valve flap 48 integral with the shell 30 of the doll body 12 is biased resiliently against the valve seat 42 to close the valve passage 46, by virtue of the resilient property of the material of shell 30.

Figure 5:
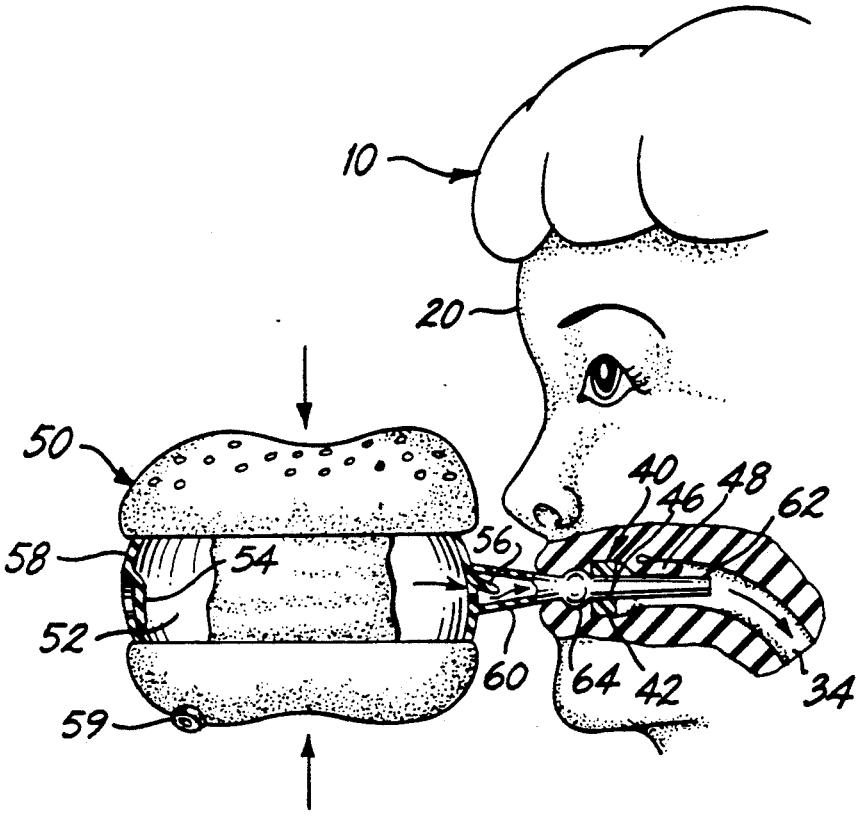
FIG. 5 is an enlarged, fragmentary view similar to FIG. 4 and demonstrating the operation of another component of the system of the invention.

When it is desired to simulate weight gain, a first apparatus, configured to simulate a weight gain object, is operated selectively to raise the pressure in the chamber 34 and thereby bring the doll body 12 to the condition illustrated in FIG. 2. Thus, as seen in FIG. 5, a first apparatus in the form of an air pump 50 is configured to simulate a hamburger, an object which, when consumed, normally will cause weight gain. Other weight gain objects, such as hot dogs, containers of soft drinks, candy and other foods which tend to promote weight gain can be simulated. The air pump 50 has a bulb-like pumping chamber 52 constructed of an elastomer and includes an inlet flap valve 54 and an outlet flap valve 56, both formed unitary with the body 58 of the air pump 50. A stem 60 is integral with the body 58 of the air pump 50 and includes a tubular tip 62 and a shoulder 64. Tubular tip 62 is generally complementary with the valve passage 46 of valve 40 so that tubular tip 62 may be inserted selectively into valve passage 46 until shoulder 64 is seated against valve seat 42 to move valve flap 48 away from valve seat 42 and bring pumping chamber 52 into communication with chamber 34 in the doll 10, as illustrated. In this manner, the stem 60 and the annular valve seat 42 serve as coupling means for selectively coupling the air pump 50 with the valve 40. Upon operation of the air pump 50, by squeezing the pumping chamber 52 as shown, the pressure within chamber 34 will be increased and wall portions 32 will expand relative to the wall portions 36 to bring the doll 10 to the condition illustrated in FIG. 2, thereby simulating weight gain and demonstrating visually the effects of weight gain. A pressure relief valve 59 is placed in the wall of the body 58 of air pump 50 to preclude the build-up of excessive pressure in the chamber 34, which excessive pressure could result in damage to the doll 10. Upon removal of the tubular tip 62 from the valve seat 42, the valve 40 will close, as illustrated in FIG. 4, and the doll 10 will remain in the expanded condition illustrated in FIG. 2.

Figure 6:
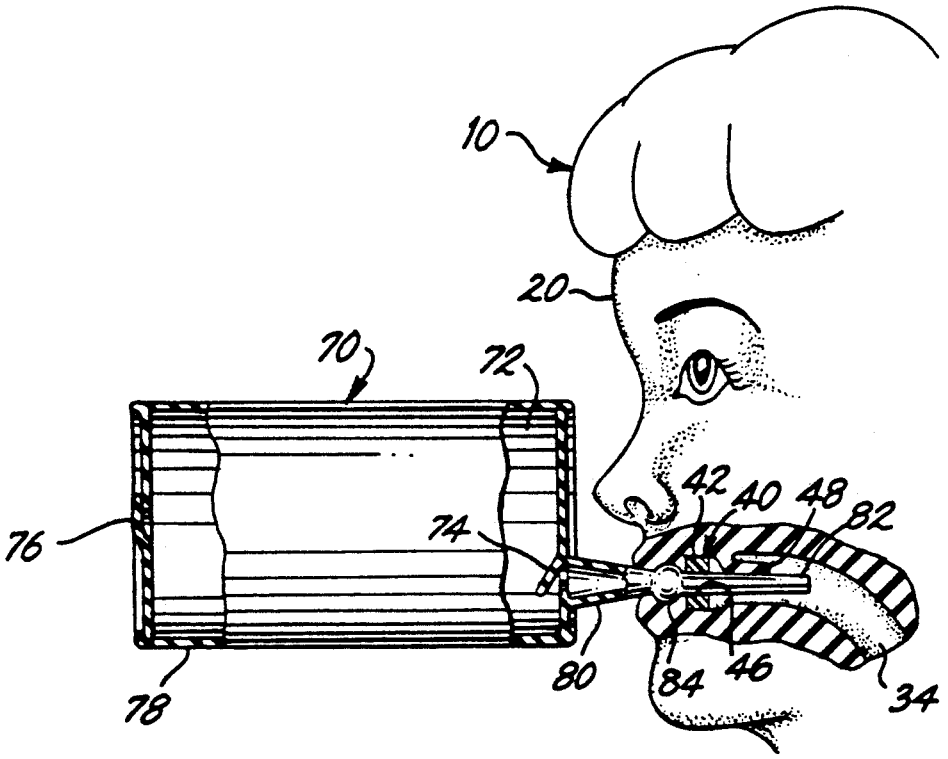
FIG. 6 is an enlarged, fragmentary view similar to FIG. 4 and demonstrating the operation of still another component of the system of the invention.

In order to simulate weight loss, a second apparatus configured to simulate a weight loss object is employed. As seen in FIG. 6, a second apparatus in the form of an exhaust pump 70 is constructed in a configuration which simulates a container of a diet drink, which, when consumed, will assist in attaining weight loss. Other weight loss objects, such as fruits, vegetables, diet supplements and other foods which assist in weight loss can be simulated. Exhaust pump 70 has a bulb-like pumping chamber 72 constructed of an elastomer and includes an inlet flap valve 74 and an outlet flap valve 76, both formed unitary with the body 78 of the exhaust pump 70. A stem 80 is integral with the body 78 of the exhaust pump 70 and includes a tubular tip 82 and a shoulder 84. Tubular tip 82 is generally complementary with the valve passage 46 of valve 40 so that tubular tip 82 may be inserted selectively into valve passage 46 until shoulder 84 is seated against valve seat 42 to move valve flap 48 away from valve seat 42 and bring pumping chamber 72 into communication with chamber 34 in the doll 10, as illustrated. In this manner, the stem 80 and the annular valve seat 42 serve as coupling means for selectively coupling the exhaust pump 70 with the valve 40. Upon operation of the exhaust pump 70, by squeezing the pumping chamber 72 as shown, the pressure within chamber 34 will be decreased and wall portions 32 will contract to bring the doll 10 to the condition illustrated in FIG. 1, thereby simulating weight loss and demonstrating visually the effects of weight loss. Upon removal of the tubular tip 82 from the valve seat 42, the valve 40 will close, as illustrated in FIG. 4, and the doll 10 will remain in the contracted condition illustrated in FIG. 1.

It will be seen that the doll 10 together with the air pump 50 and the exhaust pump 70 constitute a doll system which enables the simulation of weight gain and weight loss by the selective expansion and contraction of parts of the doll ordinarily subject to simulated weight gain and weight loss. As such, the doll system attains the various objects and advantages summarized above, namely: Provides an entertaining as well as informative doll system for educating and informing children of the effects on weight gain and weight loss of eating various foods, while at the same time entertaining the children for enhanced retention and learning about dietary matters; enables a simplified yet effective doll construction for demonstrating the effects of weight gain and weight loss on the body; provides a "hands-on" approach to teaching children about diet and the effects of the consumption of instantly recognizable commonly available foods on weight gain and on weight loss; enables children of a wide range of ages to understand and appreciate the effects of diet and weight gain and weight loss on the body; provides a doll system which is simple in use and is manufactured readily in large numbers of high quality for widespread availability with economy.

It is to be understood that the above detailed description of preferred embodiments of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A doll system enabling the simulation of weight gain and weight loss in a doll by the selective expansion and contraction of parts of the doll subject to simulated weight gain and weight loss, the doll system comprising:

a doll body having a shell including wall portions delineating the parts of the doll subject to simulated weight gain and weight loss;

a chamber within the doll body and communicating with the wall portions of the shell, the wall portions being expansible and contractible in response to raised and lowered pressure, respectively, within the chamber;

valve means normally sealing the chamber against ambient pressure;

a first apparatus configured to simulate an object representing a consumable which, when consumed, normally will cause weight gain, the first apparatus including selectively operated pressure-raising means;

a second apparatus configured to simulate an object representing a consumable which, when consumed, will assist in attaining weight loss, the second apparatus including selectively operated pressure-lowering means; and coupling means for selectively coupling one of the first apparatus and the second apparatus with the valve means such that selective coupling of the first apparatus with the valve means and operation of the first apparatus will raise the pressure within the chamber and expand the wall portions of the doll body to simulate weight gain, and selective coupling of the second apparatus with the valve means and operation of the second apparatus will lower the pressure within the chamber and contract the wall portions of the doll body to simulate weight loss.

2. The invention of claim 1 wherein the first wall portions are constructed of an elastomeric material.

3. The invention of claim 1 wherein the first apparatus includes a pump for raising the pressure within the chamber.

4. The invention of claim 1 wherein the second apparatus includes a pump for lowering the pressure within the chamber.

5. The invention of claim 1 wherein the wall of the shell is constructed of an elastomeric material, the second wall portions have a predetermined wall thickness and the first wall portions have a wall thickness less than the predetermined wall thickness of the second wall portions.

6. The invention of claim 5 wherein the wall of elastomeric material includes transitional wall portions intermediate the first wall portions and the adjacent second wall portions, the transitional wall portions having a wall thickness which increases gradually from the first wall portions to the corresponding adjacent second wall portions.

7. The invention of claim 1 wherein the doll simulates a human figure and includes a simulated face with a mouth, and the valve means and the selective coupling means are located for coupling the first apparatus and the second apparatus at the mouth of the doll.

8. The invention of claim 7 wherein the simulated human figure includes a simulated torso and simulated limbs, and at least some of the first wall portions are located along the simulated torso and the simulated limbs.

9. The invention of claim 8 wherein at least some of the first wall portions are located along the face.

10. The invention of claim 9 wherein the first wall portions are constructed of an elastomeric material.

11. The invention of claim 10 wherein the first apparatus includes a pump for raising the pressure within the chamber.

12. The invention of claim 11 wherein the second apparatus includes a pump for lowering the pressure within the chamber.

13. The invention of claim 9 wherein the wall of the shell is constructed of an elastomeric material, the second wall portions have a predetermined wall thickness, and the first wall portions have a wall thickness less than the predetermined wall thickness of the adjacent second wall portions.

14. The invention of claim 13 wherein the wall of elastomeric material includes transitional wall portions intermediate the first wall portions and the adjacent second wall portions, the transitional wall portions having a wall thickness which increases gradually from the first wall portions to the corresponding adjacent second wall portions.

* * * * *